US009591699B2

(12) United States Patent
Noh et al.

(10) Patent No.: US 9,591,699 B2
(45) Date of Patent: Mar. 7, 2017

(54) TEMPERATURE MEASURING APPARATUS AND MICROWAVE OVEN HAVING THE SAME

(71) Applicant: Samsung ELectronics Co., Ltd., Suwon-si (KR)

(72) Inventors: Tae Gyoon Noh, Suwon-si (KR); Kee Hwan Ka, Seoul (KR); Jun hoe Choi, Suwon-si (KR); Jeong Su Han, Suwon-si (KR); Yeon A Hwang, Suwon-si (KR); Yong Jong Park, Seongnam-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 1018 days.

(21) Appl. No.: 13/761,552

(22) Filed: Feb. 7, 2013

(65) Prior Publication Data

US 2014/0061190 A1 Mar. 6, 2014

(30) Foreign Application Priority Data

Aug. 29, 2012 (KR) ..... 10-2012-0095278

(51) Int. Cl.
*H05B 6/64* (2006.01)

(52) U.S. Cl.
CPC ..... *H05B 6/64* (2013.01); *H05B 6/6411* (2013.01); *H05B 6/6455* (2013.01)

(58) Field of Classification Search
CPC ..... H05B 6/6455; H05B 6/64
(Continued)

(56) References Cited

U.S. PATENT DOCUMENTS 4,864,088 A * 9/1989 Hiejima ..... H05B 6/6458 219/492
5,796,081 A * 8/1998 Carlsson ..... H05B 6/6455 219/494

(Continued)

FOREIGN PATENT DOCUMENTS

EP 2451246 5/2012
GB 2001166 1/1979

(Continued)

OTHER PUBLICATIONS

Australian Notice of Acceptance dated May 7, 2015 in Australian Patent Application No. 2013203001.

(Continued)

*Primary Examiner* — Thien S Tran
(74) *Attorney, Agent, or Firm* — Staas & Halsey LLP

(57) ABSTRACT

A microwave oven includes a tray rotatably installed inside a cooking compartment, a temperature measuring apparatus comprising a driving unit configured to generate a rotation force, and a sensing unit configured to measure the temperatures of a plurality of temperature measurement points by having a temperature measurement angle changed by the rotation force of the driving unit; and a control unit configured to control the temperature measuring apparatus to measure the plurality of temperature measurement points provided at the upper side of the tray according to a predetermined temperature measurement pattern that provides a different pattern for successive rotation periods of the tray.

21 Claims, 7 Drawing Sheets

(58) Field of Classification Search
USPC ..... 219/385, 492, 703, 705, 707, 711
See application file for complete search history.

(56) References Cited

U.S. PATENT DOCUMENTS

| | | | | |
|---|---|---|---|---|
| 2010/0027088 | A1* | 2/2010 | Lee | G02B 26/101 359/200.1 |
| 2010/0128755 | A1 | 5/2010 | Luckhardt et al. | |
| 2010/0187224 | A1* | 7/2010 | Hyde | H05B 6/705 219/720 |
| 2012/0111204 | A1* | 5/2012 | Choi | H05B 6/6455 99/331 |

FOREIGN PATENT DOCUMENTS

| | | | |
|---|---|---|---|
| GB | 2109925 | | 6/1983 |
| JP | 6-201137 | | 7/1994 |
| JP | 06201137 | * | 7/1994 |
| JP | 9-210370 | | 8/1997 |
| JP | H09210370 | * | 8/1997 |

OTHER PUBLICATIONS

Australian Examination Report issued Feb. 21, 2014 in Australian Patent Application No. 2013203001.
Extended European Search Report dated Dec. 4, 2013 from European Patent Application No. 13154671.5, 8 pages.
European Decision on Grant dated Jun. 8, 2016, in European Patent Application No. 13154671.5.

* cited by examiner

TEMPERATURE MEASURING APPARATUS AND MICROWAVE OVEN HAVING THE SAME

CROSS-REFERENCE TO RELATED APPLICATIONS

This application claims the priority benefit of Korean Patent Application No. 10-2012-0095278, filed on Aug. 29, 2012 in the Korean Intellectual Property Office, the disclosure of which is incorporated herein by reference.

BACKGROUND

1. Field

The following description relates to a microwave oven, and more particularly, to a microwave oven having a temperature measuring apparatus capable of measuring the temperature inside a cooking compartment.

2. Description of the Related Art

A microwave oven is a cooking apparatus in which radio-frequency waves being generated from a magnetron are radiated to the inside of a cooking compartment to repeatedly change the arrangement of molecules of moisture contained in food such that the food is cooked by the frictional heat generated between the molecules.

The microwave oven is provided with a body forming the external appearance thereof, and the interior space of the microwave oven is partitioned by an inner case having a rectangular shape into an inside (a cooking compartment) of the inner case and an outside (a machinery compartment) of the inner case. A tray is installed on the bottom of the inside of the cooking compartment to enable rotation while having food placed thereon, and the tray is rotated by a motor being installed at the outer surface of the bottom of the cooking compartment. In addition, the machinery compartment is provided with a magnetron configured to generate radio-frequency waves and to radiate the generated radio-frequency waves to the inside of the cooking compartment, and provided with a high-voltage transformer and a high-voltage condenser to supply the magnetron with high voltage power.

When the microwave oven operates through such a structure, the radio-frequency wave generated from the magnetron is radiated to the inside of the cooking compartment and to the food being rotated together with the tray, so that the cooking of food is achieved.

Typically, the method of cooking food using a microwave oven may be achieved in two types of cooking methods. In a first example, the output of power and the cooking time are determined based on a predetermined algorithm according to the type and amount of food, and in a second example, the cooking is performed in the course of observing the state of food. In the second example of the cooking method, which is performed in the course of observing the state of food, the efficient use of energy is ensured and an appropriate cooking is achieved when compared to the first example. However, if a method of determining the state of the food is not precise, for example, a method of measuring the temperature of the food, the food may be undercooked or overcooked, causing an inefficient operation. Accordingly, there is a need for a method of precisely measuring the temperature of food capable of correctly determining the state of food to obtain a desired result of cooking.

SUMMARY

Therefore, it is an aspect of the present disclosure to provide a temperature measuring apparatus capable of precisely measuring the temperature of food, and a microwave oven having the same.

It is an aspect of the present disclosure to provide a temperature measuring apparatus ensuring a stable and precise measurement of the temperature.

Additional aspects of the disclosure will be set forth in part in the description which follows and, in part, will be obvious from the description, or may be learned by practice of the disclosure.

In accordance with an embodiment of the present disclosure, a microwave oven includes a tray, a temperature measuring apparatus, and a control unit. The tray may be rotatably installed inside a cooking compartment, and have food placed thereon. The temperature measuring apparatus may include a driving unit and a sensing unit. The driving unit may be configured to generate a rotation force. The sensing unit may be configured to measure the temperatures of a plurality of temperature measurement points provided at an upper side of the tray, by having a temperature measurement angle thereof changed through the rotation force of the driving unit. The control unit may be configured to control the temperature measuring apparatus to measure the plurality of temperature measurement points provided at the upper side of the tray according to a temperature measurement pattern that provides a different pattern for successive rotation periods of the tray, such that at least adjacent rotation periods of the tray form different temperature measuring patterns from each other by allowing the rotation period of the tray to be asynchronous with the temperature measurement pattern of the temperature measuring apparatus.

The control unit, if the number of temperature measurement points having temperatures reaching to a predetermined target temperature among the plurality of temperature measurement points having temperatures thereof measured according to the temperature measurement pattern during at least one rotation period of the tray exceeds a predetermined number, may determine that the cooking of the food is finished and ends a cooking operation.

The control unit may forcedly end the cooking of the food if the number of temperature measurement points reaching to the predetermined target temperature among the plurality of temperature measurement points is below the predetermined number before a predetermined maximum cooking time elapses.

The temperature measurement pattern may be formed by measuring the temperatures of the plurality of temperature measurement points while sequentially moving among the plurality of temperature measurement points.

The temperature measurement pattern may be formed by measuring the temperatures while skipping some of the plurality of temperature measurement points.

The temperature measurement pattern may be formed by repeatedly measuring the temperature of a predetermined temperature measurement point among the plurality of temperature measurement points.

In accordance with an aspect of the present disclosure, a microwave oven includes a tray and a temperature measuring apparatus. The tray may be rotatably installed inside a cooking compartment and have food placed thereon. The temperature measuring apparatus may include a driving unit and a sensing unit. The driving unit may be configured to generate a rotation force. The sensing unit may be configured to measure the temperatures of a plurality of temperature measurement points provided at an upper side of the tray, by having a temperature measurement angle thereof changed through the rotation force of the driving unit, wherein a rotating shaft of the driving unit is mechanically coupled to a rotating shaft of the sensing unit to transmit the rotation force of the driving unit to the sensing unit, and the rotating shaft of the sensing unit and the rotating shaft of the driving unit are provided with locking steps, respectively, so that a mechanical coupling force between the driving unit and the sensing unit is formed through an interaction between the locking steps.

The locking steps may be formed such that the mechanical force between the driving unit and the sensing unit through the locking steps is formed in rotating directions of the rotating shaft of the sensing unit and the rotating shaft of the driving unit.

The temperature measuring apparatus may further include a guide unit. The guide unit may be configured to limit a maximum range of an angle of rotation of the sensing unit when the rotating shaft of the driving unit and the rotating shaft of the sensing unit rotate while being mechanically coupled to each other.

In accordance with an aspect of the present disclosure, a method of controlling a microwave oven comprising a tray rotatably installed at an inside a cooking compartment and having food placed thereon, and a temperature measuring apparatus comprising a driving unit configured to generate a rotation force, and a sensing unit configured to measure the temperatures of a plurality of temperature measurement points provided at an upper side of the tray, by having a temperature measurement angle thereof changed through the rotation force of the driving unit is as follows. The tray may be rotated. The temperature measuring apparatus may be controlled to measure the plurality of temperature measurement points provided at the upper side of the tray according to a temperature measurement pattern that provides a different pattern for successive rotation periods of the tray. The rotation period of the tray may be allowed to be asynchronous with the temperature measurement pattern of the temperature measuring apparatus such that at least adjacent rotation periods of the tray form different temperature measuring patterns from each other.

The method may be achieved by further performing the following. If the number of temperature measurement points having temperatures reaching to a predetermined target temperature among the plurality of temperature measurement points having temperatures thereof measured according to the temperature measurement pattern during at least one rotation period of the tray exceeds a predetermined number, the cooking of the food is determined as having been finished, and a cooking operation is ended.

The method may be achieved by further performing the following. The cooking of the food may be forcedly ended if the number of temperature measurement points reaching to the predetermined target temperature among the plurality of temperature measurement points is below the predetermined number before a predetermined maximum cooking time elapses.

The temperature measurement pattern may be formed by measuring the temperatures of the plurality of temperature measurement points while sequentially moving among the plurality of temperature measurement points.

The temperature measurement pattern may be formed by measuring the temperatures while skipping some of the plurality of temperature measurement points.

The temperature measurement pattern may be formed by repeatedly measuring the temperature of a predetermined temperature measurement point among the plurality of temperature measurement points.

In accordance with an aspect of the present disclosure, a temperature measuring apparatus includes a driving unit and a sensing unit. The driving unit may be configured to generate a rotation force. The sensing unit may be configured to measure the temperatures of a plurality of temperature measurement points provided at an upper side of the tray, by having a temperature measurement angle thereof changed through the rotation force of the driving unit, wherein a rotating shaft of the driving unit is mechanically coupled to a rotating shaft of the sensing unit to transmit the rotation force of the driving unit to the sensing unit, and the rotating shaft of the sensing unit and the rotating shaft of the driving unit are provided with locking steps, respectively, so that a mechanical coupling force between the driving unit and the sensing unit is formed through an interaction between the locking steps.

The locking protrusion may be formed such that the mechanical force between the driving unit and the sensing unit through the locking steps is formed in rotating directions of the rotating shaft of the sensing unit and the rotating shaft of the driving unit.

The temperature measuring apparatus may further include a guide unit. The guide unit may be configured to limit a maximum range of an angle of rotation of the sensing unit when the rotating shaft of the driving unit and the rotating shaft of the sensing unit rotate while being mechanically coupled to each other.

As described above, the temperature measuring apparatus in accordance with an embodiment of the present disclosure may precisely measure the temperature of the food, so that the optimum result of cooking is ensured.

In addition, the temperature measuring apparatus in accordance with an embodiment of the present disclosure and the microwave oven having the same may precisely measure the temperature of the food while ensuring a stable and precise measurement of the temperature.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
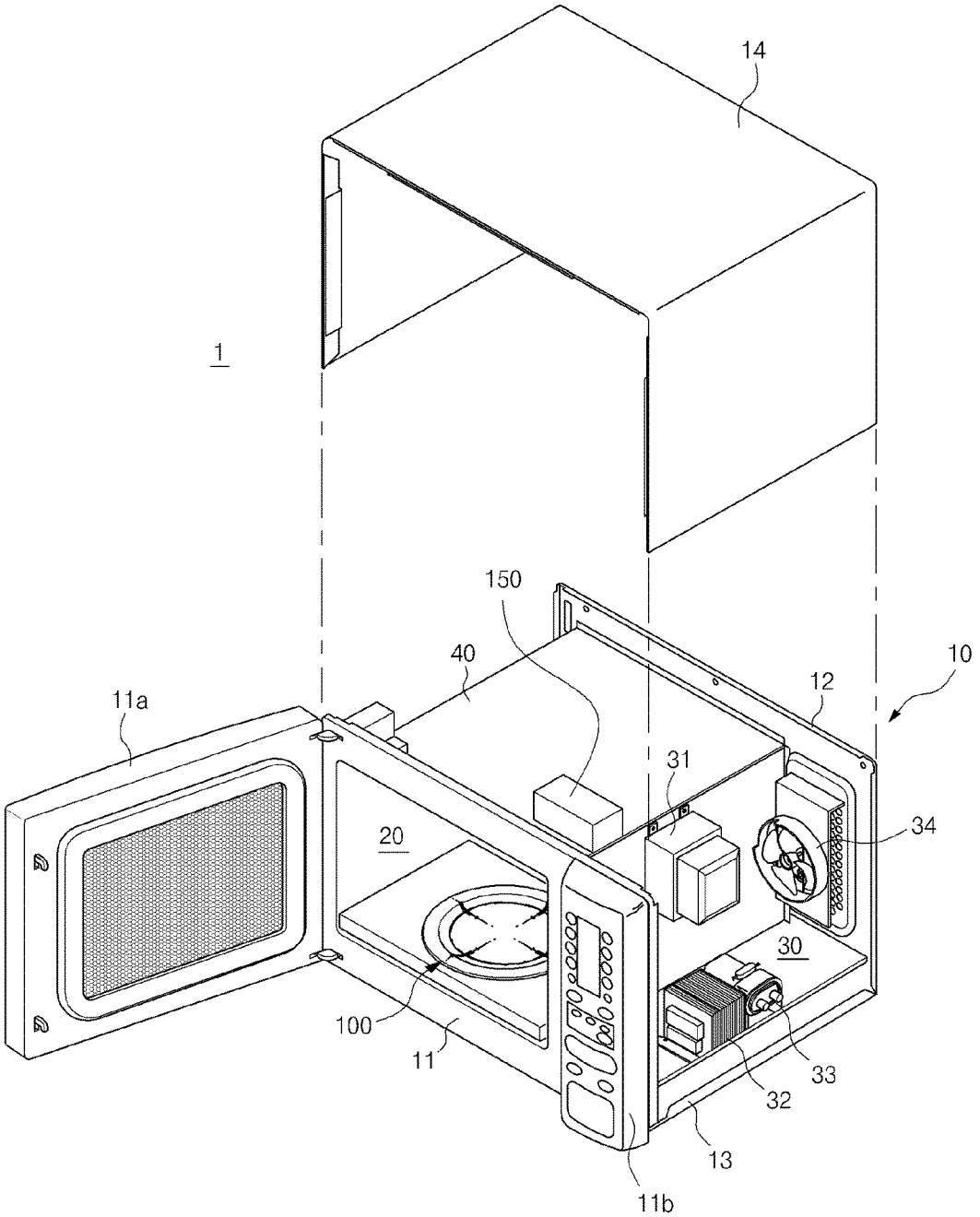
FIG. 1 is a view illustrating a microwave oven in accordance with an embodiment of the present disclosure.

Reference will now be made in detail to the embodiments of the present disclosure, examples of which are illustrated in the accompanying drawings, wherein like reference numerals refer to like elements throughout.

FIG. 1 is a view illustrating a microwave oven in accordance with an embodiment of the present disclosure. Referring to FIG. 1, the microwave oven 1 is provided with a body 10 forming the external appearance thereof. The body 10 includes a front side panel 11 and a rear side panel 12 forming a front surface and a rear surface of the body 10, respectively, a bottom panel 13 forming a bottom surface of the body 10, and a cover 14 forming both lateral surfaces and an upper surface of the body 10.

An inner case 40 is provided inside of the body 10. The inner case is provided in a rectangular shape having a front surface thereof open, and provided with an inner space thereof forming a cooking compartment 20, and an outer space thereof forming a machinery compartment 30. The front side panel 11 is provided with a door 11*a* hinged thereto to open and close the cooking compartment 20, and provided with an input unit 11*b* serving as a manipulation panel having a plurality of manipulation buttons installed thereon for an overall operation of the microwave oven 1.

At the machinery compartment 30 provided at a right side of the cooking compartment 20, a magnetron 31 is installed to generate radio-frequency waves that are supplied to the inside of the cooking compartment 20, a high voltage transformer 32 and a high voltage condenser 33 to supply the magnetron 31 with a high voltage power, and a cooling fan 34 is installed to cool off each component inside the machinery compartment 30. Inside the cooking compartment 20, a tray 100 is installed at the bottom of the cooking compartment 20 such that food is placed on the tray 100, and a waveguide pipe (not shown) is installed to guide the radio-frequency waves being radiated from the magnetron 31 to the inside of the cooking compartment 20. The tray 100 having a circular shape is selectively rotated clockwise or counterclockwise while being installed on a bottom surface of the cooking compartment 20.

When the radio-frequency waves are radiated to the inside of the cooking compartment 20 when food is placed on the tray 100 as the microwave oven 1 operates, the arrangement of molecules of moisture contained in the food is repeatedly changed by the radio-frequency waves radiated to the inside of the cooking compartment 20, and the food in the cooking compartment 20 is cooked by the frictional heat between the molecules generated when the arrangement of molecules of moisture is changed.

A temperature measuring apparatus 150 is installed at an upper side of the inner case 40 to measure the temperature of the inside of the cooking compartment 20, in particular, the temperature of the food placed on the tray 100. A temperature measurement window 160 is formed through the upper side of the inner case 40, and a part of the temperature measuring apparatus 150 is exposed to the inside of the cooking compartment 20 through the temperature measuring window 150. The temperature measuring apparatus 150 measures the temperature of the cooking compartment 20 by detecting the infrared rays being generated from the cooking compartment 20. In detail, the measuring of the temperature of the cooking compartment 20 through the temperature measuring apparatus 150 is performed to measure the temperature of the food being placed on the tray 100.

Figure 2:
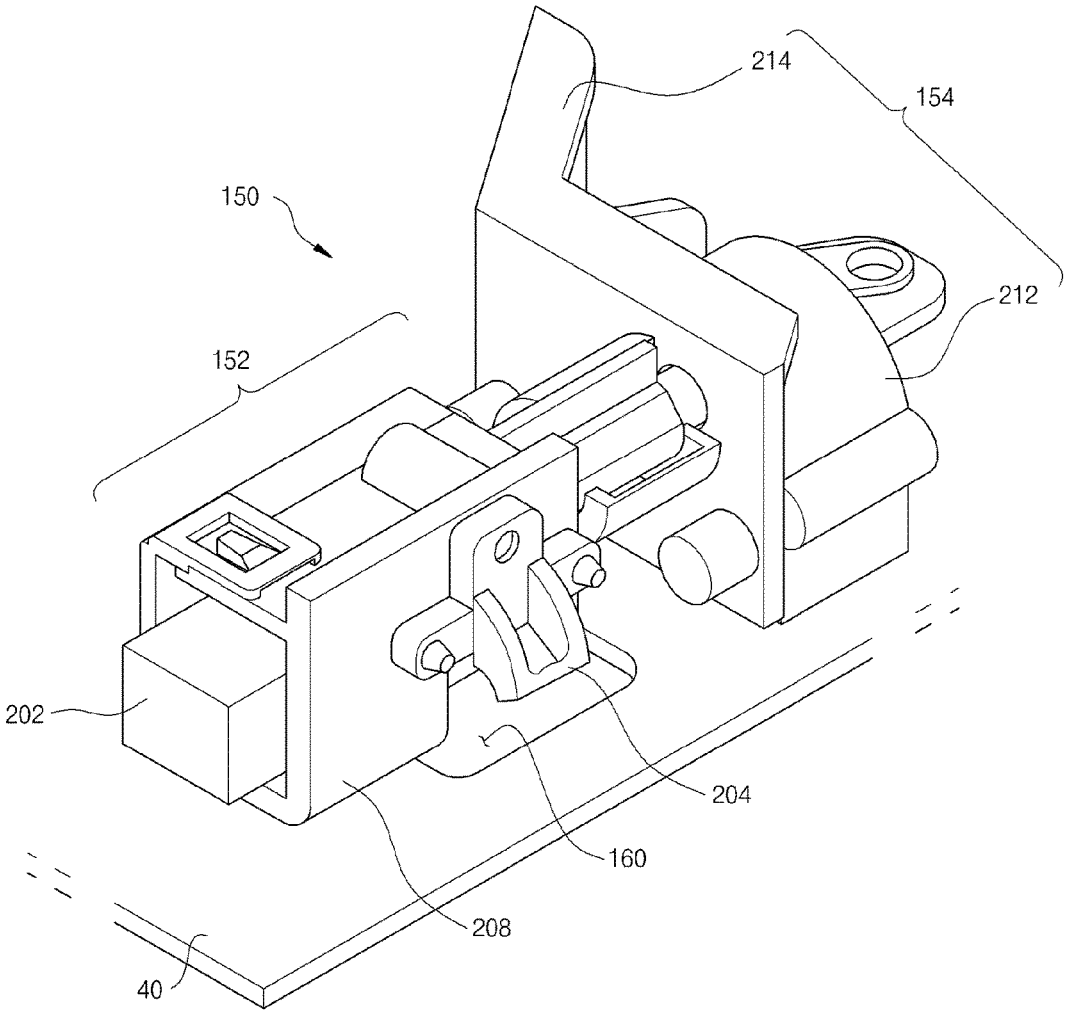
FIG. 2 is a view illustrating a temperature measuring apparatus of the microwave oven shown in FIG. 1.

FIG. 2 is a view illustrating a temperature measuring apparatus of the microwave oven shown in FIG. 1. As described above, the temperature measuring apparatus 150 in accordance with an embodiment of the present disclosure is installed such that a part of the temperature measuring apparatus 150 is exposed to the inside of the cooking compartment 20. The temperature measuring apparatus 150 includes a sensing unit 152 and a driving unit 154.

The sensing unit 152 includes a sensor 202 configured to measure the temperature in practice, a reflector 204 (see FIG. 3) configured to allow the incident infrared rays to reach the sensor 202 through reflection, a light emitter 206, such as a light emitting diode, for example, to radiate light at a temperature measuring point, and a sensor housing 208 to fix and protect the sensor 202, the reflector 204, and the light emitter 206 while mechanically coupling the sensor 202, the reflector 204, and the light emitter 206 to one another.

The driving unit 154 includes a step motor 212 and a bracket 214. The step motor 212 is fixedly installed at an upper side of the inner case 40 through the bracket 214. The sensing unit 152 is connected to a rotating shaft 216 of the step motor 212 to rotate together with the step motor 212 as the step motor 212 is driven. The rotation of the sensing unit 152 according to the driving of the step motor 212 is performed to change the direction to which a reflecting surface of the reflector 204 is directed to receive the infrared ray being radiated from a plurality of temperature measuring points inside the cooking compartment 20. That is, as the sensing unit 152 is rotated by a predetermined angle at a time according to the step motor 212 being driven, the reflecting surface of the reflector 204 also changes the direction by a predetermined angle at a time, so that the infrared rays being radiated from different points inside the cooking compartment 20 are reflected by the reflector 204 and then transmitted to the sensor 202. If the curvature of the reflecting surface of the reflector 204 is adjusted, the size of a spot of the temperature measuring point is adjusted.

Figure 3:
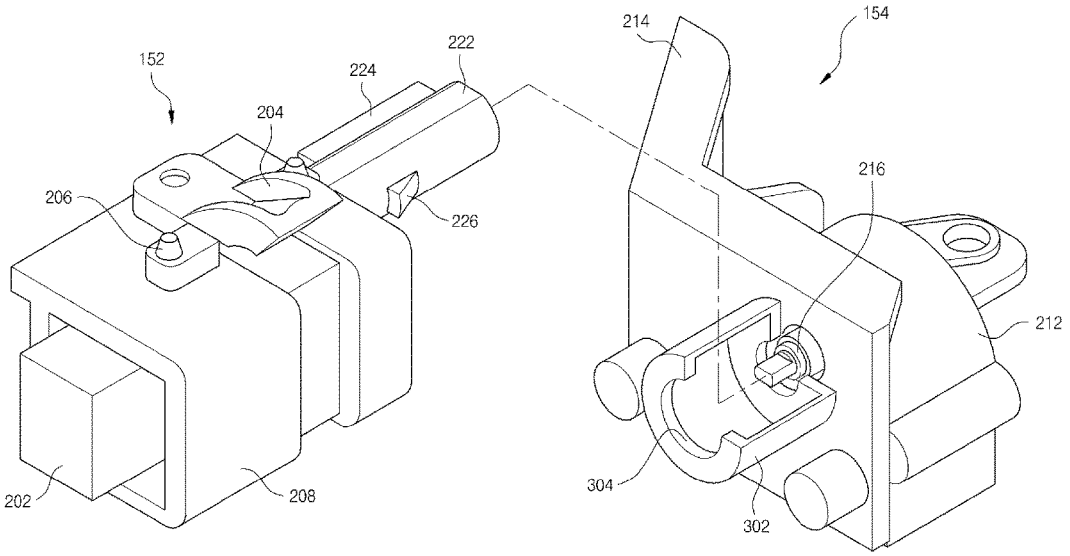
FIG. 3 is a view illustrating a connection structure of a sensing unit and a driving unit of the temperature measuring apparatus shown in FIG. 2.

FIG. 3 is a view illustrating a connection structure of a sensing unit and a driving unit of the temperature measuring apparatus shown in FIG. 2. Referring to FIG. 3, the temperature measuring apparatus 150 in accordance with an embodiment of the present disclosure has a structure capable of preventing the rotation angle of the sensing unit 152 from deviating outside a predetermined range of rotation angle. That is, a rotating shaft 222 of the sensing unit 152 has a cylindrical shape having a hollow structure, and allows the rotating shaft 216 of the step motor 212 to be inserted thereinto such that the rotating shaft 222 of the sensing unit 152 is mechanically coupled to the rotating shaft 216 of the step motor 212. Such a mechanical coupling enables the rotation force of the step motor 212 to be transmitted to the sensing unit 152. A guide unit 302 is installed around the rotating shaft 222 of the sensing unit 152. The guide unit 302 is fixed while being integrally formed with the bracket 214 to be independent of the rotations of the rotating shafts 222 and 216. The guide unit 302 is provided in the form of a cylinder having a slit portion. A protrusion 224 is formed on the outer surface of the rotating shaft 222 of the sensing unit 152. When the rotating shaft 222 of the sensing unit 152 is rotated according to the driving of the step motor 212, the protrusion 224 of the rotating shaft 222 of the sensing unit 152 is locked at both ends of the slit portion of the guide unit 302 to prevent the sensing unit 152 from being rotated further. The maximum range of the rotation angle of the sensing unit 152 at which the sensing unit 152 rotates is limited by the area of the slit portion of the guide unit 302. Accordingly, even in a case that the step motor 212 is not under control, the rotation angle of the sensing unit 152 does not deviate outside the predetermined range of angle, thereby maintaining the precision of temperature measurement.

As shown in FIG. 3, a locking step 226 is formed on the outer surface of the rotating shaft 222 of the sensing unit 152. While the protrusion 224 is configured to restrict the rotation range of the sensing unit 152 within a predetermined range of angle along a rotating direction of the rotating shaft 222 of the sensing unit 152, the locking step 226 is configured for the sensing unit 152 to generate a coupling force in an axial direction of the rotating shaft 222, so that the sensing unit 152 is mechanically coupled to the driving unit 154 to restrict and prevent the sensing unit 152 and the driving unit 154 from being separated from each other. To this end, the guide unit 302 is also provided with a locking step 304 projecting radially inwardly, so that the locking step 226 of the rotating shaft 222 of the sensing unit 152 is locked with the locking step 304 of the guide unit 302, thereby preventing the sensing unit 152 from being separated from the driving unit 154. That is, because the locking step 226 of the rotating shaft 222 of the sensing unit 152 prevents the rotating shaft 222 of the sensing unit 152 from being deviated from the guide unit 302, the sensing unit 152 and the driving unit 154 are mechanically coupled to enable rotation, thereby effectively transmitting the rotation force of the step motor 212 to the sensing unit 152.

Figure 4:
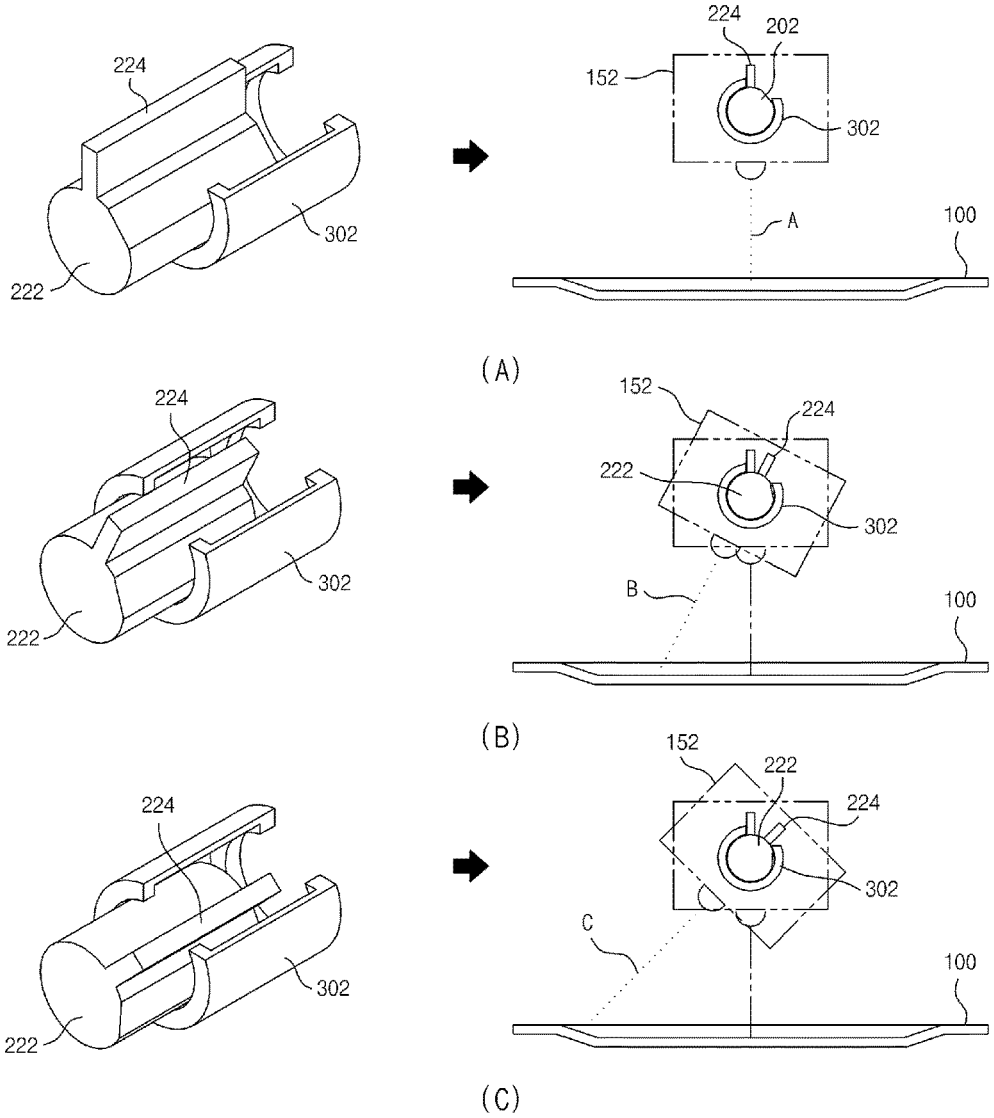
FIG. 4 part (A), FIG. 4 part (B), and FIG. 4 part (C) is a view illustrating the change of the temperature measurement position of the temperature measuring apparatus shown in FIG. 2.

FIG. 4 is a view illustrating the change of the temperature measurement position for the temperature measuring apparatus shown in FIG. 2. As described above with reference to FIG. 3, the sensing unit 152 of the temperature measuring apparatus 150 of the microwave oven 1 has the maximum range of the rotation angle defined by the area of the slit portion of the guide unit 302. If the step motor 212 rotates at a predetermined angle, the sensing unit 152 also rotates at a predetermined angle, and the direction of the reflector 204 is also changed according to the rotation of the sensing unit 152, so that the position of the temperature measurement point is changed. Accordingly, the number of points on which the temperature measurement is performed is determined depending on the number of steps which divides the maximum range of the rotation angle of the sensing unit 152 and by which the sensing unit 152 is rotated.

In accordance with an embodiment of the present disclosure, the sensing unit 152 is rotated during three different steps of angles within the maximum range of rotation angle, so that the temperature measurement is performed on three different points inside the cooking compartment 20. For example, if the sensing unit 152 is at a rotation angle shown in FIG. 4 part (A), the temperature measuring apparatus 150 may measure the temperature of a point 'A' on the tray 100. In addition, if the sensing unit 152 is at a rotation angle shown in FIG. 4 part (B), the temperature measuring apparatus 150 may measure the temperature of a point 'B' on the tray 100. If the sensing unit 152 is at a rotation angle shown in FIG. 4 part (C), the temperature measuring apparatus 150 may measure the temperature of a point 'C' on the tray 100.

Figure 5:
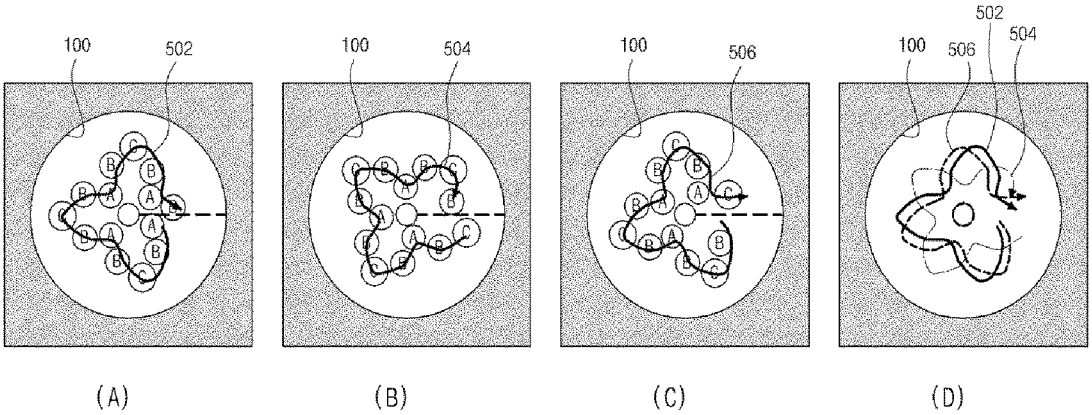
FIG. 5 part (A), FIG. 5 part (B), FIG. 5 part (C), and FIG. 5 part (D) is a view illustrating the temperature measurement pattern of food in the microwave oven shown in FIG. 2.

FIG. 5 is a view illustrating the temperature measurement pattern of food in the microwave shown in FIG. 2. The tray 100 is rotated during the cooking, and when the tray 100 is rotated, the temperature measuring apparatus 150 rotates the sensing unit 152 while changing the temperature measuring point as shown in FIG. 4, a temperature measuring pattern having a particular shape is formed during one full rotation of the tray 100. As for the temperature measuring pattern for food in the microwave oven 1 in accordance with an embodiment of the present disclosure, one temperature measuring pattern is made to be asynchronous with one rotation period of the tray 100, that is, one temperature measuring pattern is prevented from being synchronous with one rotation period of the tray 100. Being asynchronous represents that a position at which one temperature measuring pattern starts and a position at which the one temperature measuring pattern ends do not match with one rotation period of the tray 100. In this manner, when the temperature of the tray 100 is measured during a plurality of rotation periods, a different temperature measuring pattern is formed at each rotation period of the tray 100, or at least adjacent rotation periods of the tray 100 form different temperature measuring patterns from each other.

The temperature measuring pattern, while the tray 100 is rotating, may be formed as the sensor unit 152 measures the temperatures while moving among the temperature moving points 'A', 'B', and 'C' as shown in FIG. 4. That is, the temperature measuring pattern may be formed in various shapes by combining a method in which the sensor unit 152 measures the temperatures while sequentially moving among the temperature moving points 'A', 'B', and 'C', a method in which the sensor unit 152 measures the temperatures while skipping some of the temperature moving points 'A', 'B', and 'C', and a method in which the sensor unit 152 repeatedly measures the temperature of a particular temperature measuring point.

First, at a Nth rotation period of the tray 100, a temperature measuring pattern 502 shown in FIG. 5 part (A) is formed through the adjustment of the angle of the sensing unit 152 of the temperature measuring apparatus 150. On FIG. 5, points "A", "B", and "C" represent the points "A", "B", and "C" shown in FIG. 4, respectively. In addition, at a N+1th rotation period of the tray 100, a temperature measuring pattern 504 shown in FIG. 5 part (B) is formed through the adjustment of the angle of the sensing unit 152 of the temperature measuring apparatus 150. In addition, at a N+2th rotation period of the tray 100*a* temperature measuring pattern 506 shown in FIG. 5 part (C) is formed through the adjustment of the angle of the sensing unit 152 of the temperature measuring apparatus 150. As described above, because the temperature measuring pattern of the microwave oven 1 in accordance with an embodiment of the present disclosure is obtained while being asynchronous with one rotation period of the tray 100, the temperature measuring patterns 502, 504, and 506 formed at the respective rotation periods of the tray 100 have different shapes from one another.

If the temperature measuring patterns 502, 504, and 506 shown in FIG. 5 parts (A), (B), and (C), respectively, are made to overlap one another, it is proven that the temperature measurement is equally performed over the entire area of the surface of the tray 100 as shown in FIG. 5 part (D). If the temperature measuring pattern of the microwave oven 1 is obtained while synchronous with one rotation period of the tray 100 different from an embodiment of the present disclosure, the temperature measuring pattern formed at each rotation period of the tray 100 is the same, and thus the temperature measurement is not equally performed over the entire areas of the surface of the tray 100 as shown in FIG. 5 part (D), but performed on the same position of the tray 100 at each rotation period of the tray 100. In this case, if food is positioned at a particular portion on the tray 100 instead of equally distributed over the entire area of the surface of the tray 100, the temperature measurement may be frequently performed on the surface of the tray 100 other than the food, thereby failing to achieve a precise temperature measurement. However, the temperature measuring apparatus in accordance with an embodiment of the present disclosure performs the temperature measurement over the entire area of the surface of the tray 100 as shown in FIG. 5 part (D), so that the temperature of food is precisely measured even if the food is positioned at a particular portion on the tray 100.

Because the microwave oven 1 in accordance with an embodiment of the present disclosure is configured to radiate light at a current temperature measurement point through the light emitter 206 provided on the sensing unit 152, when the temperature measurement is performed according to the temperature measurement patterns 502, 504, and 506 shown in FIG. 5 parts (A), (B), and (C) during the rotation of the tray 100, a trace of light having the same shape as a trace of each of the temperature measurement pattern 502, 504, and 506 is formed inside the cooking compartment 100, providing a pleasing visual effect for a user. In addition, the temperature measurement patterns 502, 504, and 506 vary at each rotation period of the tray 100, thereby significantly reducing the boredom or tedium that may occur when the temperature measurement is performed according to the same temperature measurement pattern at each rotation period of the tray 100.

Figure 6:
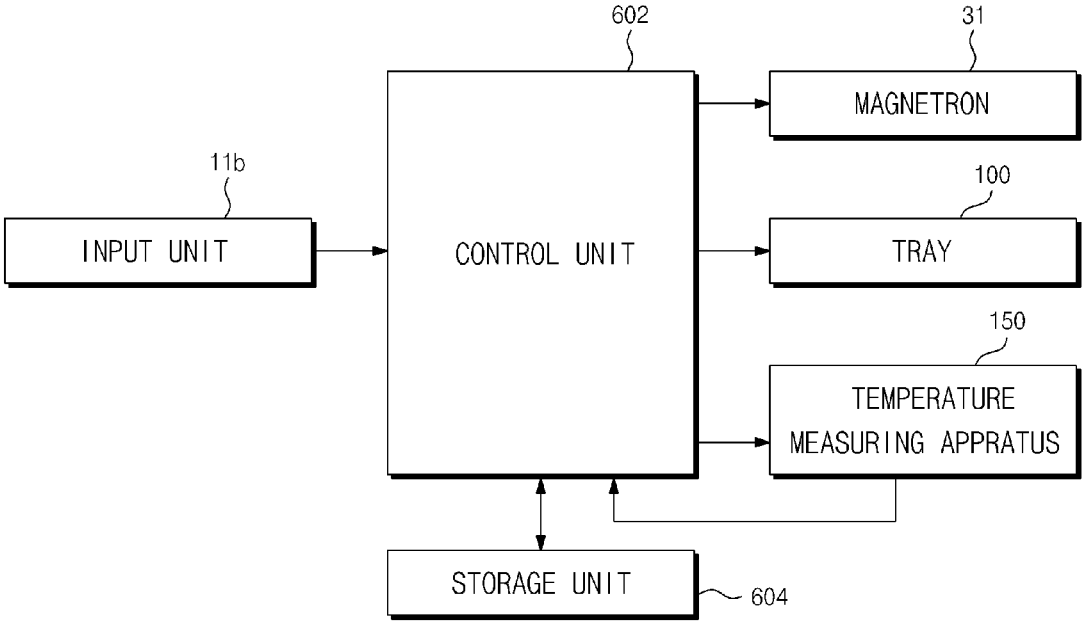
FIG. 6 is a view illustrating a control system of the microwave oven shown in FIG. 1.

FIG. 6 is a view illustrating a control system of the microwave oven shown in FIG. 1. Referring to FIG. 6, the input unit 11*b* serving as a manipulation panel having a plurality of manipulation buttons installed thereon is connected to an input side of a control unit 602 to control the overall operation of the microwave oven 1 to enable a communication with each other. The storage unit 604 stores software needed for the control unit 602 to control the overall operation of the microwave oven 1, and data generated during the control process. The magnetron 31, the tray 100, and the temperature measuring apparatus 150 are connected to an output side of the control unit 602 to enable a communication with one another. The control unit 602 receives a cooking mode setting being input through the input unit 11*b* from a user, and controls the output of the microwave of the magnetron 31 and the rotation of the tray 100 such that the corresponding cooking is performed. In addition, the control unit 602 forms the temperature measurement patterns as shown in FIGS. 4 and 5 by controlling the rotation of the sensing unit 152 of the temperature measuring apparatus 150 such that the temperature at an inside the cooking compartment 20, in particular, the temperature of food being placed on the tray 100 is measured, and the control unit 602 receives temperature data measured by the temperature measuring apparatus 150. The control unit 602 determines the status of cooking operation by referring to the temperature data provided from the temperature measuring apparatus 150, and determines the point of time for ending cooking.

Figure 7:
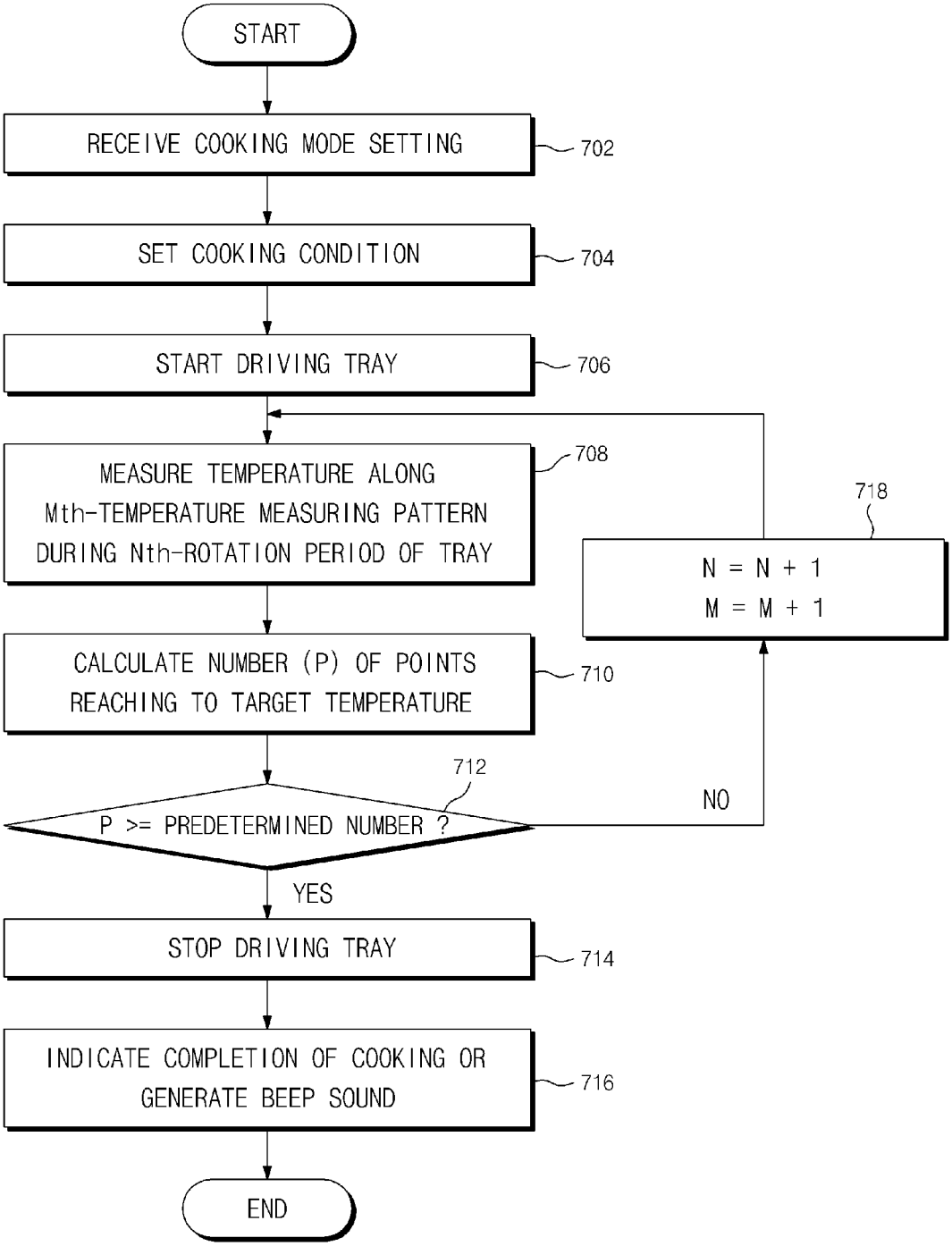
FIG. 7 is a flow chart illustrating a method of controlling a microwave oven in accordance with an embodiment of the present disclosure.

FIG. 7 is a flow chart illustrating a method of controlling a microwave oven in accordance with an embodiment of the present disclosure. Referring to FIG. 7, a method of controlling the microwave oven 1 provides a method of measuring the temperature of food by use of the temperature measuring apparatus 150 in accordance with an embodiment of the present disclosure, and a method of determining the point of time for ending the cooking based on the result of temperature measurement of food.

First, the control unit 602 receives a cooking mode setting being input through the input unit 11*b* from a user (702). In this case, a cooking mode being set may be directly designated as a particular cooking mode by a user, or may be determined by the control unit 602 based on the state of food, for example, the type and weight of food and the frozen state of food. If the cooking mode is determined, the control unit 602 sets cooking conditions required for performing the determined cooking mode (704). Examples of the cooking conditions include the intensity of output of the magnetron 31, and the cooking time. The cooking mode in accordance with an embodiment of the present disclosure shown in FIG. 7 is assumed that the control unit 602 determines the point of time for ending the cooking by referring to the result of temperature measurement of food. If the cooking mode is determined and the cooking conditions are set, the control unit 602 starts driving the tray 100 to perform a cooking operation corresponding to the corresponding cooking mode and cooking conditions (706). The rotation speed of the tray 100 may vary with a cooking mode.

In accordance with an embodiment of the present disclosure, the control unit 602 measures the temperature of the food according to the Mth temperature measurement pattern during the Nth rotation period (708). Except when the cooking time is significantly short, the tray 100 makes a plurality of rotations in order to perform a single cooking operation. The Nth rotation period represents the period of a rotation among the plurality of rotations required to perform one cooking operation. The Mth temperature measurement pattern represents one of the various temperature measurement patterns that are shown in FIG. 5 parts (A), (B), and (C).

The control unit 601, while measuring the temperature of food according to the Mth temperature measurement pattern during the Nth rotation period, receives temperature data corresponding to each temperature measurement point shown in FIG. 5 parts (A), (B), and (C) from the temperature measuring apparatus 150. The control unit 602 calculates the number of temperature measurement points having temperatures reaching to a predetermined target temperature among the plurality of temperature measurement points having temperatures thereof measured according to the Mth temperature measurement pattern during the Nth rotation period of the tray 100 (710). For example, when assumed that the plurality of temperature measurement points having temperatures thereof measured according to the Mth temperature measurement pattern during the Nth rotation period of the tray 100 is 14 (see FIG. 5 part (A)), the number of temperature measurement points having temperatures reaching to a predetermined target temperature among the total of 14 temperature measurement points is calculated. The target temperature may be 100 degrees, for example.

If the number of temperature measurement points having temperatures reaching to the predetermined target temperature of 100 degrees exceeds a predetermined number (YES from 712), the control unit 602 determines that the cooking of food is completed, stops driving the tray 100 (714), and outputs a notice message indicating the completion of cooking or generates a beep sound (716). If a result of determination of operation 712 is that the number of temperature measurement points having temperatures reaching to the predetermined target temperature of 100 degrees does not exceed the predetermined number (NO from 712), the control unit 602 determines that the cooking of food is not completed and keeps rotating the tray 100 (N=N+1), and changes the temperature measurement pattern of the temperature measuring apparatus 150 (M=M+1), so that the cooking of food is maintained while continuously measuring the temperature (718).

The control unit 602 may forcedly end the cooking if the number of temperature measurement points having temperatures reaching to the predetermined target temperature is below the predetermined number before a predetermined maximum cooking time elapses, thereby preventing overheating. The control unit 602 may apply a different temperature measurement pattern to each rotation period of the tray 100, or apply different temperature measurement patterns from each other to at least adjacent rotation periods of the tray 100, respectively. For example, the control unit 602 may apply different temperature measurement patterns from each other to a N−1 rotation period of the tray 100 and a N+1 rotation period of the tray 100, respectively.

The above-described embodiments may be recorded in computer-readable media including program instructions to implement various operations embodied by a computer. The media may also include, alone or in combination with the program instructions, data files, data structures, and the like. The program instructions recorded on the media may be those specially designed and constructed for the purposes of embodiments, or they may be of the kind well-known and available to those having skill in the computer software arts. Examples of computer-readable media include magnetic media such as hard disks, floppy disks, and magnetic tape; optical media such as CD ROM disks and DVDs; magneto-optical media such as optical disks; and hardware devices that are specially configured to store and perform program instructions, such as read-only memory (ROM), random access memory (RAM), flash memory, and the like. The computer-readable media may also be a distributed network, so that the program instructions are stored and executed in a distributed fashion. The program instructions may be executed by one or more processors. The computer-readable media may also be embodied in at least one application specific integrated circuit (ASIC) or Field Programmable Gate Array (FPGA), which executes (processes like a processor) program instructions. Examples of program instructions include both machine code, such as produced by a compiler, and files containing higher level code that may be executed by the computer using an interpreter. The above-described devices may be configured to act as one or more software modules in order to perform the operations of the above-described embodiments, or vice versa.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A microwave oven comprising:

a tray rotatably installed inside a cooking compartment, for having food placed thereon;

a temperature measuring apparatus comprising a driving unit configured to generate a rotation force, and a sensing unit configured to measure temperatures of a plurality of temperature measurement points by having a temperature measurement angle thereof changed through the rotation force of the driving unit; and a control unit configured to control the temperature measuring apparatus to measure the plurality of temperature measurement points according to a predetermined temperature measurement pattern formed in a plurality of different patterns to provide a different pattern for successive rotation periods of the tray.

2. The microwave oven of claim 1, wherein the control unit, if the number of temperature measurement points having temperatures reaching to a predetermined target temperature among the plurality of temperature measurement points having temperatures thereof measured according to the temperature measurement pattern during at least one rotation period of the tray exceeds a predetermined number, determines that cooking of the food is finished and ends a cooking operation.

3. The microwave oven of claim 2, wherein the control unit forcedly ends the cooking of the food if the number of temperature measurement points reaching to the predetermined target temperature among the plurality of temperature measurement points is below the predetermined number before a predetermined maximum cooking time elapses.

4. The microwave oven of claim 1, wherein the temperature measurement pattern is formed by measuring the temperatures of the plurality of temperature measurement points while sequentially moving among the plurality of temperature measurement points.

5. The microwave oven of claim 1, wherein the temperature measurement pattern is formed by measuring the temperatures while skipping some of the plurality of temperature measurement points.

6. The microwave oven of claim 1, wherein the temperature measurement pattern is formed by repeatedly measuring the temperature of a predetermined temperature measurement point among the plurality of temperature measurement points.

7. The microwave oven of claim 1, wherein at least adjacent rotation periods of the tray form different temperature measuring patterns from each other by allowing the rotation period of the tray to be asynchronous with the temperature measurement pattern of the temperature measuring apparatus.

8. The microwave oven of claim 1, wherein a rotating shaft of the driving unit is mechanically coupled to a rotating shaft of the sensing unit to transmit the rotation force of the driving unit to the sensing unit, and the rotating shaft of the sensing unit and the rotating shaft of the driving unit are provided with locking steps, respectively, so that a mechanical coupling force between the driving unit and the sensing unit is formed through an interaction between the locking steps.

9. The microwave oven of claim 8, wherein the locking steps are formed such that the mechanical force between the driving unit and the sensing unit through the locking steps is formed in axial directions of the rotating shaft of the sensing unit and the rotating shaft of the driving unit.

10. The microwave oven of claim 8, wherein the temperature measuring apparatus further comprises a guide unit configured to limit a maximum range of an angle of rotation of the sensing unit when the rotating shaft of the driving unit and the rotating shaft of the sensing unit rotate while being mechanically coupled to each other.

11. A method of controlling a microwave oven comprising a tray rotatably installed inside a cooking compartment and having food placed thereon, and a temperature measuring apparatus comprising a driving unit configured to generate a rotation force, and a sensing unit configured to measure temperatures of a plurality of temperature measurement points by having a temperature measurement angle thereof changed through the rotation force of the driving unit, the method comprising:

rotating the tray;

controlling the temperature measuring apparatus to measure the plurality of temperature measurement points according to a predetermined temperature measurement pattern formed in a plurality of different patterns to provide a different pattern for successive rotation periods of the tray.

12. The method of claim 11, further comprising:

determining, if the number of temperature measurement points having temperatures reaching to a predetermined target temperature among the plurality of temperature measurement points having temperatures thereof measured according to the temperature measurement pattern during at least one rotation period of the tray exceeds a predetermined number, that cooking of the food is finished; and ending a cooking operation.

13. The method of claim 12, further comprising:

forcedly ending the cooking of the food if the number of temperature measurement points reaching to the predetermined target temperature among the plurality of temperature measurement points is below the predetermined number before a predetermined maximum cooking time elapses.

14. The method of claim 11, wherein the temperature measurement pattern is formed by measuring the temperatures of the plurality of temperature measurement points while sequentially moving among the plurality of temperature measurement points.

15. The method of claim 11, wherein the temperature measurement pattern is formed by measuring the temperatures while skipping some of the plurality of temperature measurement points.

16. The method of claim 11, wherein the temperature measurement pattern is formed by repeatedly measuring the temperature of a predetermined temperature measurement point among the plurality of temperature measurement points.

17. The method of claim 11, further comprises allowing the rotation period of the tray to be asynchronous with the temperature measurement pattern of the temperature measuring apparatus such that at least adjacent rotation periods of the tray form different temperature measuring patterns from each other.

18. The method of claim 11, wherein a rotating shaft of the driving unit is mechanically coupled to a rotating shaft of the sensing unit to transmit the rotation force of the driving unit to the sensing unit, and the rotating shaft of the sensing unit and the rotating shaft of the driving unit are provided with locking steps, respectively, so that a mechanical coupling force between the driving unit and the sensing unit is formed through an interaction between the locking steps.

19. The method of claim 18, wherein the locking steps are formed such that the mechanical force between the driving unit and the sensing unit through the locking steps is formed in axial directions of the rotating shaft of the sensing unit and the rotating shaft of the driving unit.

20. The method of claim 18, further comprising a guide unit configured to limit a maximum range of an angle of rotation of the sensing unit when the rotating shaft of the driving unit and the rotating shaft of the sensing unit rotate while being mechanically coupled to each other.

21. A non-transitory computer-readable recording medium storing a program to implement the method of claim 11.

* * * * *